US006844015B2

(12) United States Patent
Yuguchi

(10) Patent No.: US 6,844,015 B2
(45) Date of Patent: Jan. 18, 2005

(54) BREW-IN-THE-CUP DISPOSABLE BEVERAGE ASSEMBLY

(76) Inventor: Clifford Yuguchi, 10321 Lorenzo Dr., Los Angeles, CA (US) 90064

( * ) Notice: Subject to any disclaimer, the term of this patent is extended or adjusted under 35 U.S.C. 154(b) by 207 days.

(21) Appl. No.: 10/326,722

(22) Filed: Dec. 19, 2002

(65) Prior Publication Data

US 2004/0118295 A1 Jun. 24, 2004

(51) Int. Cl.[7] ..... B65B 29/02

(52) U.S. Cl. ..... 426/78; 426/82; 426/86; 426/113; 426/115; 99/295; 206/0.5

(58) Field of Search ..... 426/77–78, 82, 426/86, 106, 112, 113, 115; 206/0.5; 99/295

(56) References Cited

U.S. PATENT DOCUMENTS 2,743,664 A * 5/1956 Sheldon ..... 99/295
3,370,524 A * 2/1968 Kasakoff ..... 99/287
3,446,624 A * 5/1969 Luedtke ..... 426/77
3,579,351 A * 5/1971 Wege et al. ..... 426/82
3,615,708 A * 10/1971 Abile-Gal ..... 426/77
3,797,642 A * 3/1974 Dobry et al. ..... 426/82
3,971,305 A * 7/1976 Daswick ..... 99/295
4,020,969 A * 5/1977 Ando ..... 220/359.2
4,039,435 A * 8/1977 Narva ..... 206/217
4,417,504 A * 11/1983 Yamamoto ..... 99/306
4,627,334 A * 12/1986 Shanklin ..... 99/306
5,043,172 A * 8/1991 Loizzi ..... 426/77
5,132,124 A * 7/1992 Tamaki et al. ..... 426/82
5,424,083 A * 6/1995 Lozito ..... 426/82
5,736,042 A * 4/1998 Aoki ..... 210/474
5,738,786 A * 4/1998 Winnington-Ingram ..... 210/474
5,937,737 A * 8/1999 Karell ..... 99/287
6,065,609 A * 5/2000 Lake ..... 210/474
6,298,771 B1 * 10/2001 Calvento ..... 99/323
6,692,780 B1 * 2/2004 Sandin ..... 426/77
6,705,471 B2 * 3/2004 Kataoka ..... 210/474
6,715,616 B2 * 4/2004 Kataoka ..... 210/474

* cited by examiner

*Primary Examiner*—Drew Becker
(74) *Attorney, Agent, or Firm*—Hogan & Hartson, LLP

(57) ABSTRACT

A brew-in-the-cup disposable beverage assembly includes a cup and a beverage pouch containing a premeasured charge of beverage material. The pouch is packaged within an airtight bag to preserve the freshness of the beverage material until use. The beverage pouch rests on supporting structure extending inwardly from the cup sidewall supported in an upper region of the cup. An aroma enhancing substance is included in the beverage material. For use, the airtight bag is removed from the beverage pouch which is then placed on the supporting structure and liquid is poured onto the pouch to brew the beverage and drain into the cup.

12 Claims, 7 Drawing Sheets

BREW-IN-THE-CUP DISPOSABLE BEVERAGE ASSEMBLY

CROSS-REFERENCES TO RELATED APPLICATIONS

There are no related applications.

STATEMENT REGARDING FEDERALLY SPONSORED RESEARCH AND DEVELOPMENT

Not applicable.

REFERENCE TO A "MICROFICHE APPENDIX"

Not applicable.

BACKGROUND OF THE INVENTION

1. Field of the Invention

The present invention relates to a brew-in-the-cup disposable beverage assembly for brewing of a beverage, such as, for example, coffee, which contains everything necessary for making a freshly brewed, individual serving in the cup by the addition of liquid.

2. Description of the Related Art

There have been a number of proposals for brew-in-the-cup assemblies intended to enable a beverage drinker to take a preassembled cup containing all the dry ingredients needed and, by the addition of water or some other liquid, prepare an individual serving of beverage brewed in the cup. Such a product could have great appeal for sales through convenience stores, supermarkets, military and institutional users, camping goods stores, and many other outlets. For example, a consumer could buy a six-pack of the cup assemblies and use them as the need arises to create a cup of hot coffee, or other hot beverage, approaching a comparable level of quality to that expected at national-chain coffee houses.

In achieving this result, there are certain requirements which applicant has concluded need to be met. Since the brew-in-the-cup assembly may be in shelf storage for months or more, it is advantageous to prevent the beverage material, such as fresh coffee grounds or loose tea, from losing its flavor and freshness due to exposure to air. It would be desirable to provide an enhanced aroma of the beverage to excite the user's sense of smell and create a favorable anticipatory experience. A customer should receive a cup whose interior cleanliness is preserved during a long storage period against the intrusion of dust, insects or pollutants and which can assure the customer that it has not been tampered with. The customer should be served every time with a premeasured charge of the beverage material of the correct weight and qualities required to provide a beverage which is in the range of preferred consumer preferences, i.e., not too weak and not too strong. Moreover, if a hot or cooled beverage is desired, the cup should have adequate thermal insulation qualities to prevent over-rapid change in temperature of the drink or discomfort to the touch. Finally, the product should be easy to use, capable of manufacture at a cost level competitive with other delivery systems for the beverage, and disposable when the beverage has been consumed.

A number of prior devices intended to provide a brew-in-the-cup disposable beverage assembly are shown in prior patents. For example, U.S. Pat. No. 6,298,771 to Calvento discloses a generally cylindrical, coated paper "beverage receptacle," which receives a "brewing cup" that has a conical shape with a filter sheet incorporated as its bottom wall. The filter sheet forms a space for holding a charge of beverage material, e.g., ground coffee. The beverage materials, which can be in a vacuum sealed portion, are stored inside the beverage receptacle. At the time of use, the beverage materials are transferred to the filter sheet and water is then poured into a disposable brewing cup to flow through the grounds into the beverage receptacle. The brewing cup and grounds are removed from the beverage receptacle before the hot beverage is drunk. Use of this device requires the user to perform a manual step of transferring the beverage material, e.g., ground coffee, from its original packaging to the filter region of the brewing cup. Such a procedure inherently involves some risk of messiness and inconvenience in the step of transferring the beverage materials to the filter paper of the brewing cup. In a dust-laden environment, this step might even expose the beverage materials to incorporate outside pollutants during the transfer step. Moreover, if the transfer is done poorly, through inattention, carelessness or lack of dexterity of the user, there can be a risk that the beverage materials may be distributed unevenly on the filter region leaving channels through which the liquid may pass through directly without infusion into the beverage material.

Another brew-in-the-cup assembly for hot beverages is disclosed in U.S. Pat. No. 5,424,083 to Lozito. The Lozito invention discloses making of coffee in a nondisposable mug, using a disposable conical "brewing cone" sized to fit into the open end of the mug. The brewing cone has a filter mesh at the downwardly facing apex of the cone which contains a premeasured charge of beverage material enclosed in a permeable filter net. For use, water is poured into the brewing cone, passes through the beverage material in the filter portion and drains into the cup. The charge of coffee trapped above the permeable filter net is described as "premeasured." However, the Lozito patent does not contain any disclosure for airtight packaging of the premeasured beverage material charge that would preserve its freshness during any extended period of shelf storage before the time of use.

Accordingly, the present inventor has sought to achieve a brew-in-the-cup disposable beverage assembly which will avoid potential drawbacks of the prior art of the character described and satisfy the earlier-noted requirements for a disposable brew-in-the-cup beverage cup assembly.

SUMMARY OF THE INVENTION

Applicant's invention is a brew-in-the-cup disposable beverage cup assembly which is intended to satisfy the above-discussed requirements for such a product and to overcome the above-described potential disadvantages of the prior art.

Applicant's brew-in-the-cup disposable beverage cup assembly uses a premeasured charge of beverage material through which liquid is passed to create the beverage. In a preferred embodiment, the disposable beverage container includes a cup having a generally tubular sidewall, a closed bottom wall and an open top rim. A beverage pouch, stored within the cup, has upper and lower walls of filter material which enclose and contain the charge of beverage material and a peripheral region which closely conforms to the cup sidewall. An airtight bag encloses the beverage pouch to exclude air from the beverage material before the time of use. Underlying support structure, connected to the cup's inner sidewall, projects inwardly to support the beverage pouch in an upper region of the cup below the top rim. At the time of use, the airtight bag is removed from the beverage pouch which is then placed on the support structure and liquid is poured onto the beverage pouch to pass through the beverage material and fill the cup with the beverage.

This arrangement eliminates any need for the customer to transfer loose beverage material, e.g., loose coffee grounds or loose tea leaves, from its packaging to a filter region of a brewing cup. Moreover, the airtight bag protects the freshness and flavor of the beverage material during weeks or months of shelf storage right up to the time of use when the airtight bag is removed and discarded.

Another aspect of the invention intended to enhance the experience of the user of the product is the inclusion of an aroma-enhancing substance within the beverage pouch with the beverage material, which yields a stronger aroma of the beverage, e.g., hot coffee, when the liquid is poured onto the pouch than the aroma that would be provided by the beverage material alone.

A further aspect of the invention includes pouch reinforcement structure connected to the pouch which reinforces its shape in the peripheral region so that the pouch does not deform enough to come unseated from the support structure as liquid is passed through the pouch.

Another aspect of the invention is structure intended to provide thermal insulation for the beverage within the cup both to lengthen the time before it changes its temperature and to make the cup more comfortable to hold during drinking. In a preferred embodiment, the cup has an outer wall, extending from the closed bottom to the top rim, and a complementary inner wall, against the outer wall, from the bottom to an upper region of the cup. The double thickness of wall material contributes significantly to adequate insulation qualities. In the preferred embodiment referred to, the inner and outer walls, in their lower regions, are integral and sealed to the bottom wall.

In an alternative embodiment, the cup may be a plastic material conventionally used for beverage cups, such as polyethylene, polypropylene and polystyrene. The plastic wall has good insulating qualities and is sufficiently thick to possess rigidity to the level required to enable the cup to be used for contained liquids without collapsing. The plastic may be in a foamed, solid state, such as foamed polystyrene.

BRIEF DESCRIPTION OF THE DRAWINGS

A brew-in-the-cup disposable beverage assembly according to the invention is illustrated in the following drawings in which.

DETAILED DESCRIPTION

Figure 1:
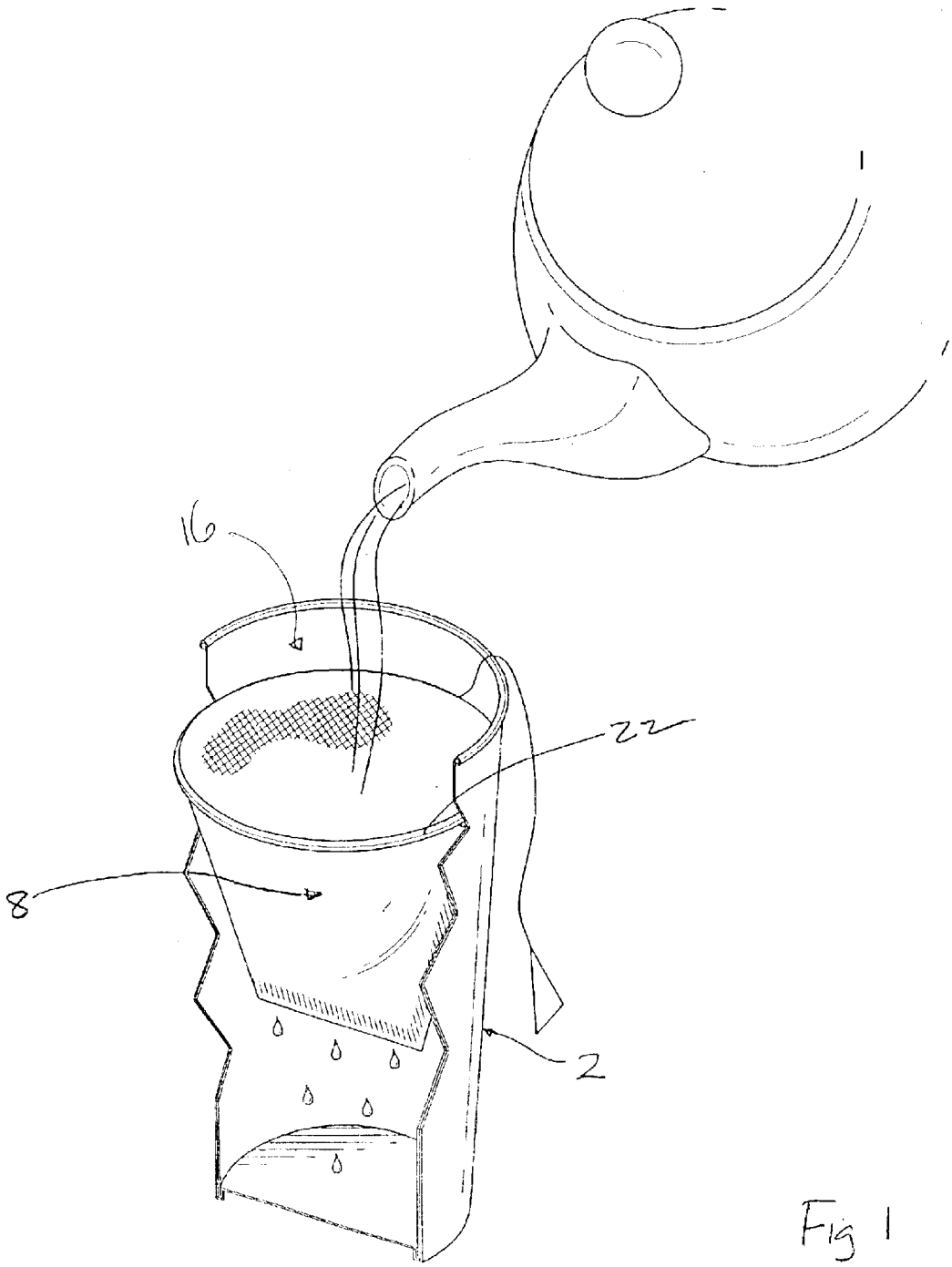
FIG. 1 is a partially sectioned, perspective view of the brew-in-the-cup beverage assembly during the addition of the liquid, with packaging removed.

Parts of a brew-in-the-cup disposable beverage assembly in accordance with a preferred embodiment of the invention are illustrated in FIG. 1. The assembly includes a disposable cup 2, having a generally tubular sidewall and a top rim 4. The sidewall is generally tubular although other conventional cup shapes may be employed if desired. "Generally tubular" included frusto-conical and other hollow shapes defined by a closed periphery such as oval, square, triangular, polygonal or irregular. The receptacle can be in several sizes: 20 oz., 16 oz., 12 oz. and 8 oz. In the preferred embodiment, the cup is a standard 20 fluid ounce cup. A beverage pouch 8, containing a premeasured charge of beverage material, is placed within the cup. An airtight bag 9 (FIG. 4) surrounds the beverage pouch to preserve the freshness of the beverage material until the time of use, when the bag is torn away and discarded.

The term "beverage material" as used herein denotes any conventional, dry beverage source substance for brewing a beverage through which a liquid can be poured to create the beverage. Beverage material includes, for example, without limitation, substances used for creating hot beverages such as ground coffee, leaf tea, chocolate powder or materials for producing a clear hot soup, as well as vegetable, fruit or berry materials known for their beverage-producing qualities. The term beverage material also includes substances that can be used for producing cold beverages such as dry beverage mixes used for producing lemonade or iced tea. Many suitable beverage materials will include a soluble component as well as insoluble components which it is desired to retain in the pouch and keep out of the beverage draining into the cup.

Figure 2:
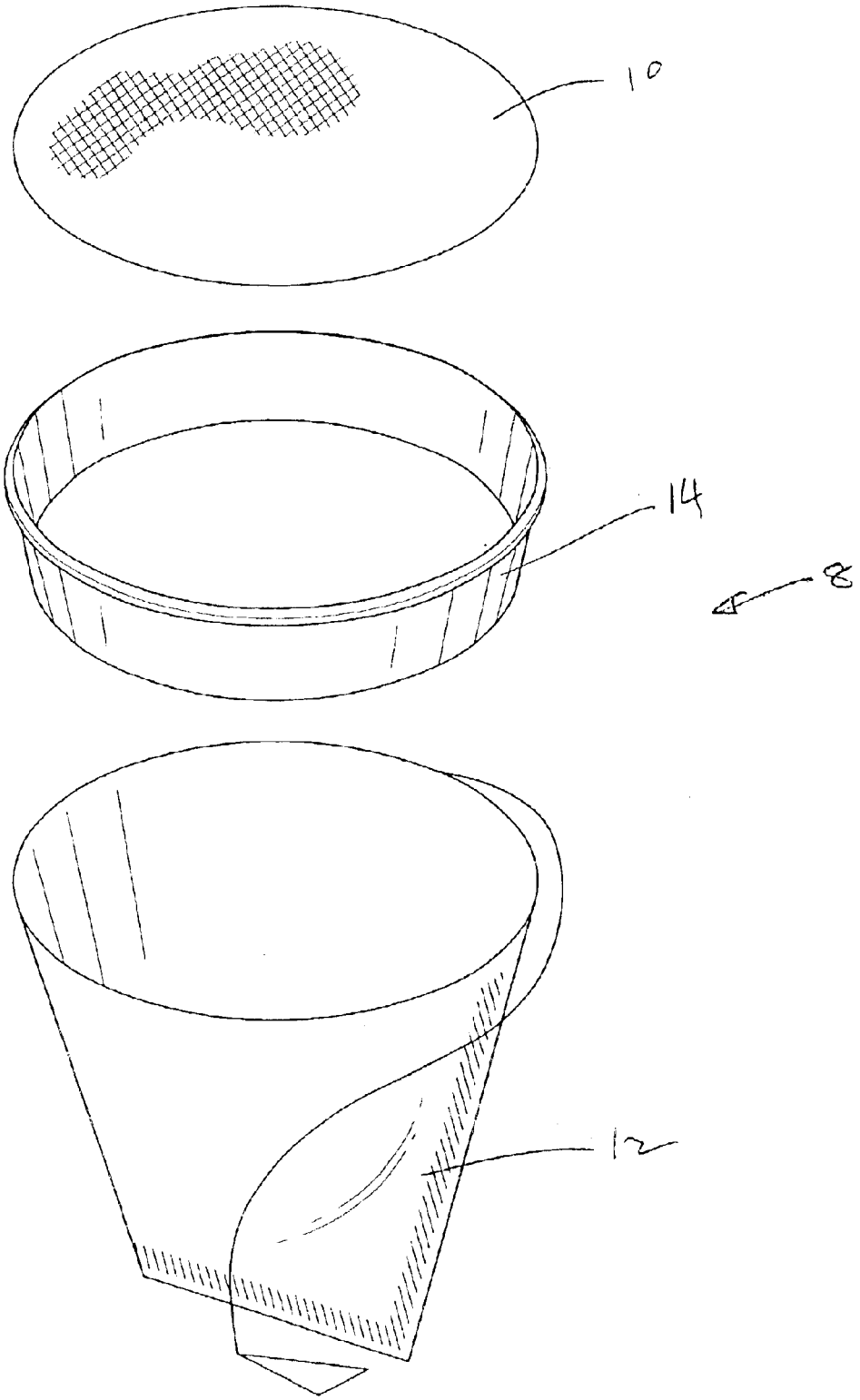
FIG. 2 is an exploded view of a beverage pouch forming part of the assembly shown in FIG. 1.
Figure 3:
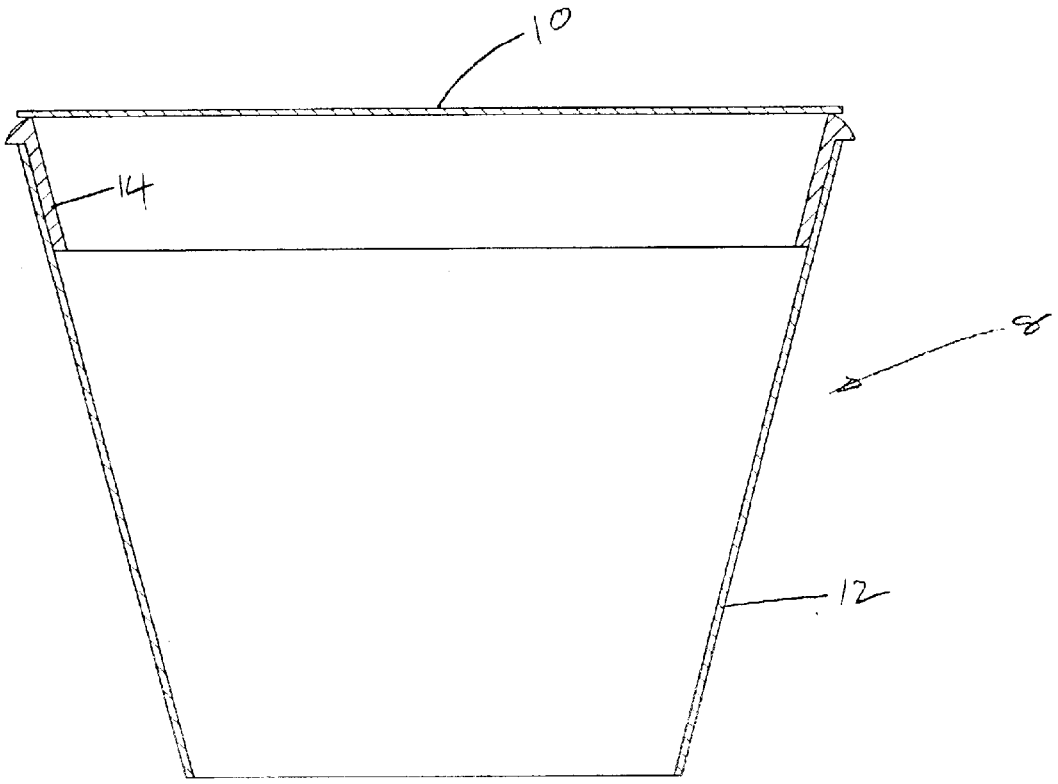
FIG. 3 is a cross-sectional, assembled view of the beverage pouch shown in FIG. 2.

The beverage pouch 8, as shown in more detail in FIGS. 2 and 3, includes an upper wall 10 having generally the same shape and size as the cross-section of the cup 2 in its upper region. The upper wall 10 is connected to a bag-shaped lower wall 12. The upper and lower walls 10 and 12 are joined together and connected to a pouch reinforcement structure 14 by use of a nontoxic, tasteless, odorless glue, by heat sealing, or by other conventional joining expedients. The pouch reinforcement structure 14 is a loop (for example, resembling the rim and adjacent upper region of a paper cup) having sufficient rigidity to support and maintain the shape of the bag even when it is soaked with liquid, e.g., heated water. Materials suitable for the pouch reinforcing structure 14 include plastics such as polystyrene and polypropylene. Alternatively, a stiff card paper, coated to prevent loss of stiffness by liquid immersion, can possess the required degree of rigidity to function acceptably as the pouch reinforcing structure. The pouch reinforcing structure 14 should have sufficient flexibility and resilience to enable the pouch to be easily pushed inside the cup 2 during assembly without permanent deformation.

The upper and lower walls 10 and 12 completely enclose the premeasured charge of beverage material. The premeasured charge fills the interior volume of the beverage pouch 8 and has not been separately illustrated in order to avoid obscuring the clarity of the figures showing the pouch structure. The walls 10 and 12 are made of a filter material in which the filter pores are small enough to prevent passage of solid beverage material out of the pouch into the beverage in the cup, while allowing the liquid used to infuse the beverage material to pass freely through and drain into the cup. It is necessary that the filter material have sufficient strength that it should not become weakened by the passage of the liquid to the extent that it loses its desirable filtering properties. A suitable filter material that can be used is a fine mesh polyester or polyethylene fiber filter fabric available, for example, from Unie Kafue KK of Japan, or Yamanaka Sangyo KK of Japan or Kuray Co. Ltd. of Japan or beverages filter material available from JR Crompton Ltd., Manchester, England.

Figure 5:
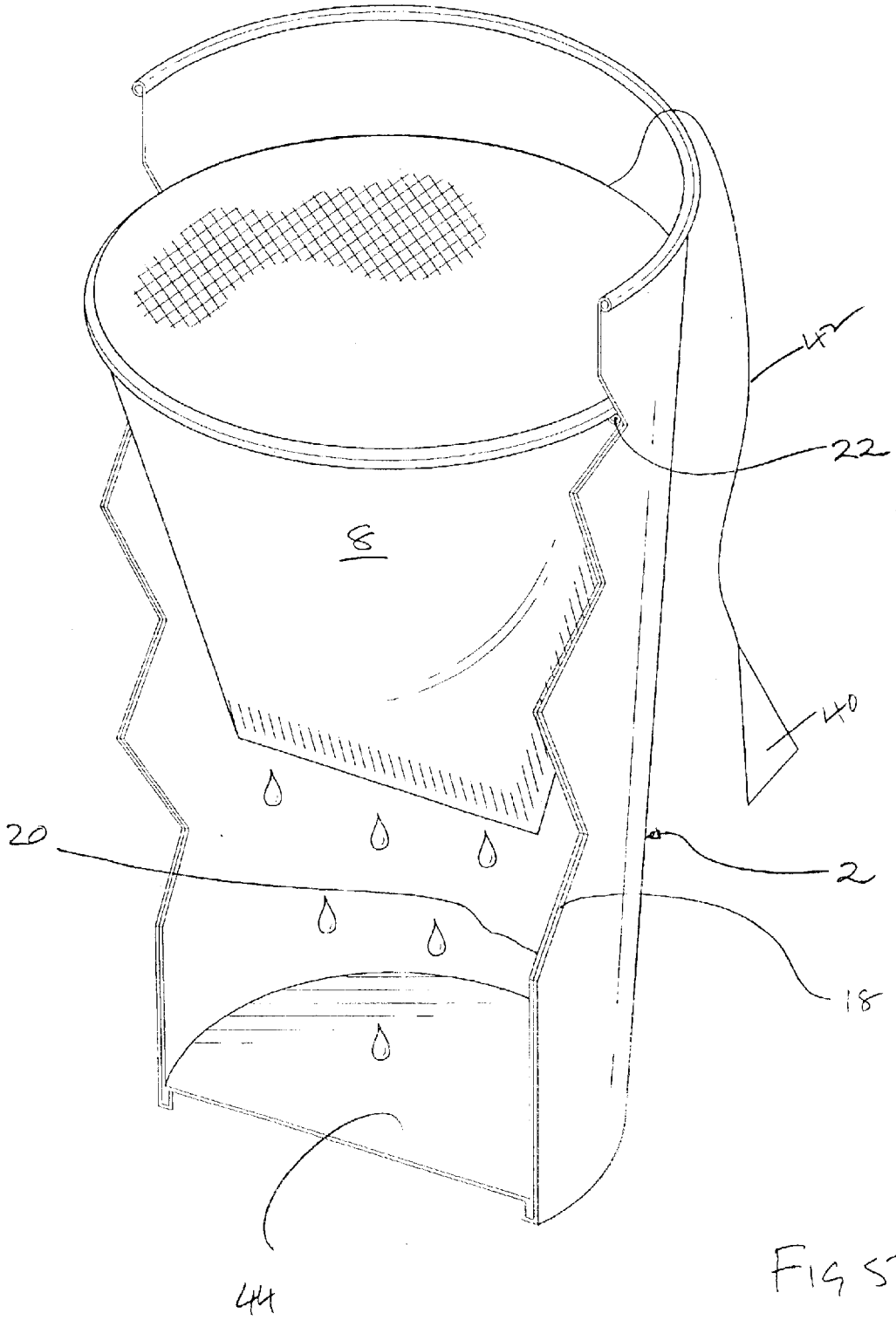
FIG. 5 is a partially sectioned, perspective view of the brew-in-the-cup disposable beverage assembly, according to the invention, in which the inner airtight pouch has been removed and the pouch has been placed in the position which it occupies when a liquid is being introduced to brew the beverage.

The support structure 14 supports the beverage pouch in an upper region of the cup 2 which forms a well 16 (FIG. 1). The liquid, e.g., hot water, may be poured into the well to drain through the beverage pouch and its contents into the body of the container as the beverage. The pouch rests upon supporting structure embodied, in a preferred embodiment, by an inner rim 22 within the cup spaced below the top rim. The cup and both rims will now be more fully described. The cup 2 (FIG. 5) has an outer wall 18 which is sufficiently rigid to withstand the liquid pressures exerted on it by the beverage which it will contain for the normal time span that the cup will be in use. Suitable materials for the outer wall of the cup 18 include coated cardboard or one of the plastics conventionally used for disposable cups, such as polystyrene, polyethylene or polypropylene. In the preferred embodiment, a suitable material is Fourdrinier cup stock paper cup stock available from PMC Corporation, 8900 West Bradley Road, Milwaukee, Wis. The inner rim 22 is formed as a bead along the top edge of an inner wall 20 of the same material as the outer wall extending upwardly from the bottom of the cup doubled back against the outer wall. The inner rim 22 extends in closely spaced relation around the interior of the outer wall at a level spaced sufficiently below the top rim of the outer wall to create the previously-mentioned well 16. For example, the vertical distance from the rim on the outer wall to the inner rim is typically about an inch although this distance may be varied as desired. For example, using the standard 20 fluid ounce beverage cup, this will result in about 15–16 fluid ounces of brewed beverage. The inner rim 22 underlies and supports the support loop 14 and adjacent portions of the beverage pouch 8 to hold the pouch in an upper region of the cup. The upper surface of the beverage pouch fits snugly within the interior surface of the cup 2 around its periphery to substantially prevent liquid from by-passing around the edge of the beverage pouch without passing through the beverage material. The double walling strengthens the cup and also increases its thermal insulation properties.

Figure 4:
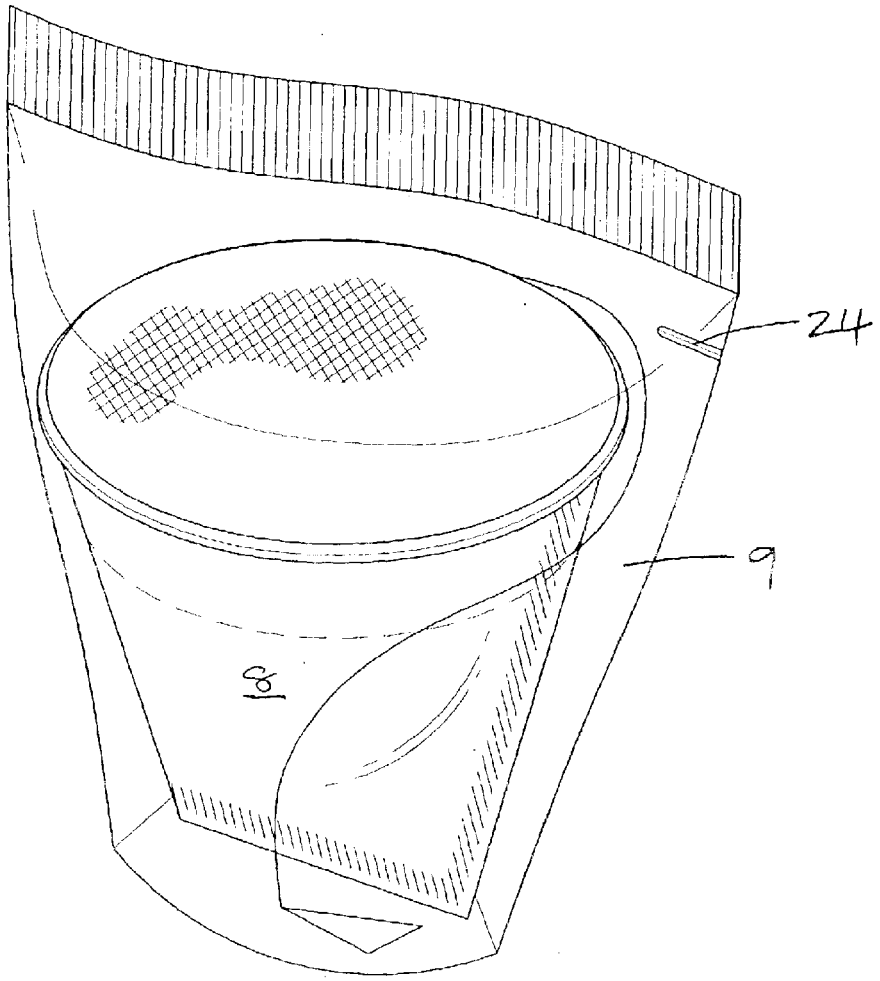
FIG. 4 is a perspective view of the beverage pouch shown in FIG. 2 packaged in a disposable airtight bag.

It is desirable to preserve the freshness and flavor of the beverage material as much as possible during prolonged shelf storage. Therefore, the beverage pouch 8 is packaged within the airtight bag 9 (FIG. 4). The bag 9 may be shaped to generally conform to the shape of the beverage pouch within it. The airtight bag is a hermetically sealed, gas impervious metalized plastic foil or, alternatively, it may be transparent. To add eye appeal, the airtight bag can be imprinted with eye-catching graphics and colors. One suitable example of such a foil is 120 gauge metallized cast polypropylene available from Vacumet Corp., 4780 Bakers Ferry Road, Atlanta, Ga. A tear strip or tear initiating notch (not shown) is provided on the airtight bag 24 to enable it to be conveniently torn and detached from the beverage pouch when the time for use comes.

A feature of the invention intended to increase the desirability of the user experience that it provides includes an aroma-intensifying substance with the beverage material. When the user adds hot liquid to the beverage material, he or she will experience an enhanced, intense aroma of the beverage material. For example, it is known to add a volatile essence having a strong aroma of freshly ground coffee to ground coffee so that, when the foil package is removed and hot water is poured on the coffee grounds, an intensified aroma, stronger than would be provided by the beverage material alone, will be experienced by the drinker.

Figure 6:
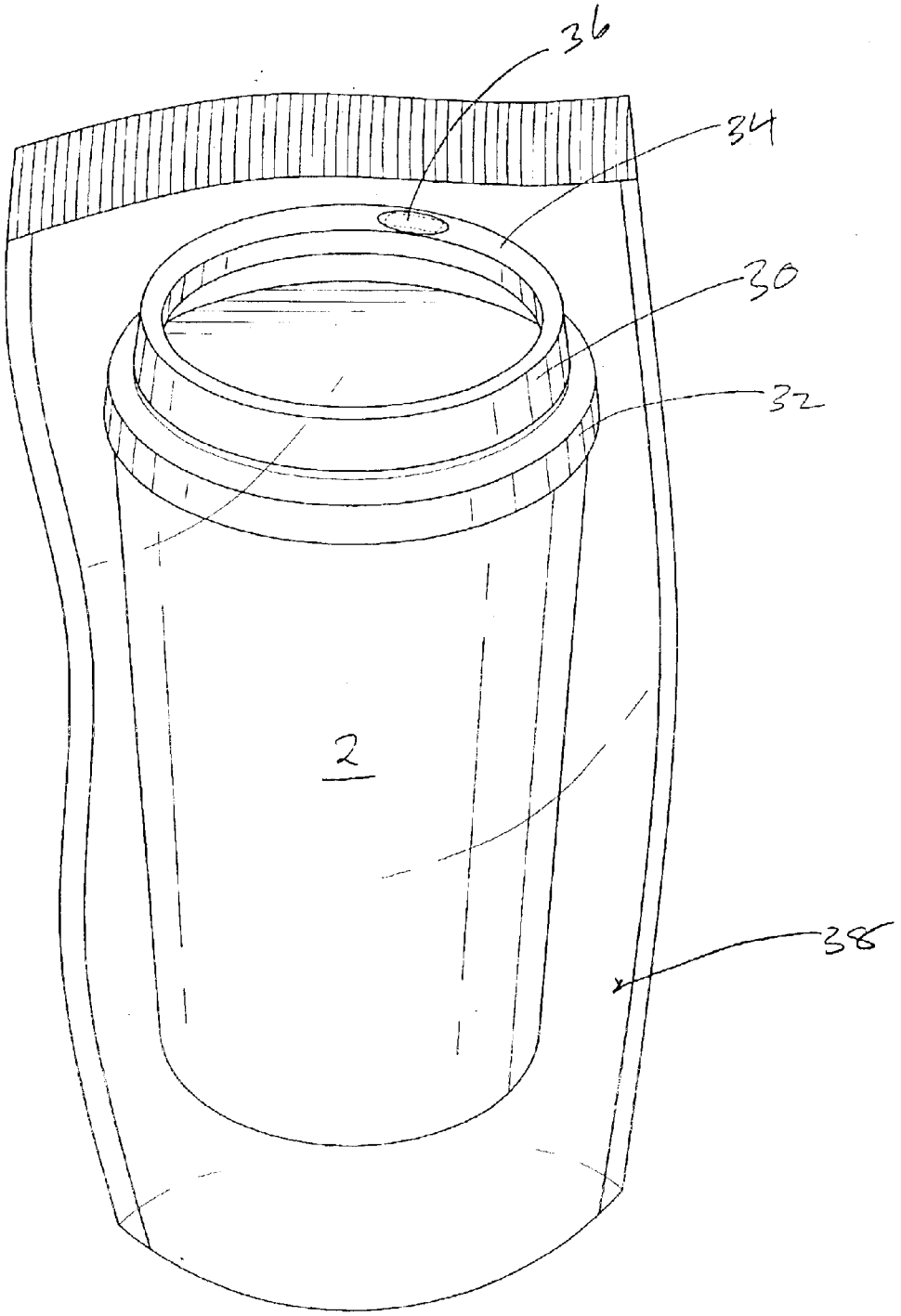
FIG. 6 shows the brew-in-the-cup disposable beverage assembly packaged including a protective outer bag forming part of the assembly.

A further aspect of the preferred embodiment involves the presence of a snap-on drinking cap 30 (FIG. 6). The cap has a lower circular rim 32 shaped to snap fit onto the beaded top rim 4 of the cup 2. It also has an upper circular rim 34 provided with a drinking aperture 36 through which the user may drink the beverage.

Figure 7:
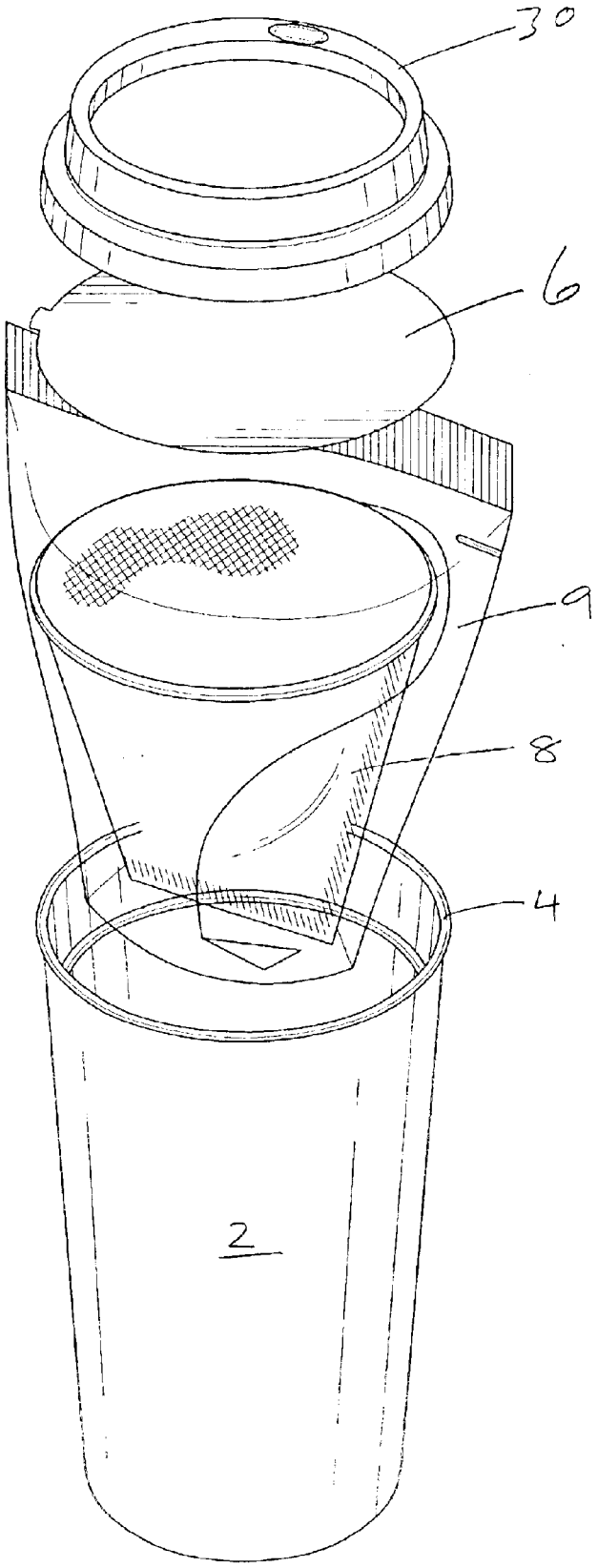
FIG. 7 is an exploded view of the assembly.

During manufacture of the assembly, the beverage pouch 8 and beverage material 9 together with the surrounding airtight outer bag 9 (preassembled together), will be placed within the cup 2. Other materials may also be stored within the cup such as, for example, creamer, sweetener, and a stirring stick. Then, a disc shaped cover 6 (FIG. 7) will be sealed to the upper rim, using conventional techniques, e.g., using a glue to close the cup. The cover serves the functions of keeping out dust, pollutants and insects during prolonged shelf storage and of acting as a tamper indicator so that the user can check that no one has tampered with the contents before the product is used. Then, the cap 30 is snapped onto the rim 4 of the cup. Finally, an individual outer bag 38 (FIG. 6) is placed around the assembled unit and sealed to preserve its cleanliness and, also, to act as a further indication that tampering has not occurred. Alternatively, the assembly can be wrapped in a shrink wrap packaging such as Fujiwrap which intimately conforms to the shape of the assembly to facilitate stacking assemblies together. All these assembly steps may be automated for high-volume production. It is contemplated that the packaged units may be sold in groups, for example, in six packs or twelve packs.

When the time comes for use of the product, the user tears off the outer bag 38 from the unit, lifts off the lid 30, and peels the cover off the top end of the cup. The user then lifts out the airtight bag and beverage pouch from the interior of the cup, and any other enclosed items, and tears away the airtight bag 9 from the beverage pouch. After which, the user places the beverage pouch back in the cup in position, resting on the inner rim 22, and pours liquid, e.g., hot water if hot coffee or hot tea is the desired beverage, into the well region above the beverage pouch. The liquid passes through the beverage material creating the beverage which drains into and fills the cup. When the cup is filled, which will become apparent when the liquid ceases to drain through the beverage pouch and starts to accumulate on its top surface, the beverage pouch can be pulled out by grasping a pull tab 40, attached by a string 39 to the beverage pouch to the beverage pouch, and discarded. Alternatively, a commonly used tea string could be employed. After that, the lid can be replaced and the beverage consumed.

In an alternative embodiment, the double walled cup can be replaced by using a single walled, molded plastic cup, e.g., a molded plastic foam. When using a plastic cup, the support structure underlying the rim of the beverage pouch can be molded directly into the interior surface of the cup as either a continuous ring or a series of inwardly projecting protuberances, positioned to support the beverage pouch at the desired spacing from the upper rim 4.

The cup includes a bottom wall 44 (FIG. 5) which is sealingly secured to the cup sidewall about its entire periphery. In the preferred embodiment, the sidewall material can be bent around and secured to a downwardly projecting lip about the periphery of the bottom wall 44. Other conventional forms of seaming a cup bottom to a cup sidewall may be employed. Moreover, if a molded cup is utilized, the cup bottom wall 44 can be molded integrally with the sidewall.

The invention is limited only by the appended claims. It will be appreciated by persons skilled in the art that variations in details and features from those described, which would be obvious to a person skilled in this art, may be made without departing from the inventions set forth in the accompanying claims.

I claim:

1. A brew-in-the-cup disposable beverage assembly using a premeasured charge of beverage material through which liquid is passed to create the beverage, the assembly comprising:

a cup having a sidewall defining a hollow interior, a bottom wall and an open top rim;

a beverage pouch, completely enclosing the premeasured charge of beverage material, having upper and lower filter wall regions, which permit the liquid to pass through while retaining the beverage material within the beverage pouch, and a peripheral region shaped to conform closely to said cup sidewall in an upper region thereof;

an airtight bag enclosing said beverage pouch to exclude air from the beverage material, said airtight bag being removable from said beverage pouch for use thereof;

pouch support structure connected to said cup sidewall projecting inwardly therefrom, said support structure underlying said beverage pouch adjacent said peripheral region to support said pouch in the upper region of said cup adjacent to said top rim; and wherein, upon removal of said airtight bag from said beverage pouch and placement of said pouch on said support structure with said pouch extending across the interior of said cup, the liquid is poured onto said beverage pouch to pass through and brew with the beverage material thereby providing the beverage in said cup.

2. A brew-in-the-cup disposable beverage assembly as defined in claim 1 further including, pouch reinforcement structure connected to said pouch which reinforces the shape of the pouch in the peripheral region so that the pouch does not deform enough to become unseated from the support structure as liquid is passed through the pouch.

3. An assembly as defined in claim 2 wherein said reinforcement structure comprises a loop of resilient, flexible material conforming to said peripheral region having sufficient rigidity to maintain the shape and stiffness of the cup during passage of the liquid.

4. An assembly as defined in claim 1 further including, an aroma-intensifying substance included within said beverage pouch which, when contacted with the liquid, releases an enhanced aroma compared to the aroma which the beverage material by itself would provide.

5. An assembly as defined in claim 1 wherein, said cup sidewall comprises, an outer sidewall extending between said bottom wall and said top rim; and an inner sidewall extending between said bottom wall and said outer wall doubled back against said outer wall;

and wherein said supporting structure comprises:

an inner rim extending peripherally along an upper end of said inner wall spaced below said top rim.

6. An assembly as defined in claim 1 further including:

a cup cover secured to said top rim of said cup to protect the interior of said cup during storage and to act as an indication that tampering has not occurred, said cover being removed or pierced prior to use to permit access to the interior of said cup.

7. An assembly as defined in claim 1 further including a cap removably fitted to said top rim of said cup, said cap having a drinking aperture therein to permit a user to drink the beverage from the cup with said cap in position on said rim.

8. An assembly as defined in claim 1 wherein said cup is formed from a moldable plastic material which retains the shape and stiffness of the cup at at least the temperatures of boiling water, said supporting structure being formed directly in said cup sidewall.

9. An assembly as defined in claim 1 wherein, said cup is generally frusto-conical extending upwardly and outwardly from said bottom wall and, further, wherein said pouch upper wall is generally flat and circular and said pouch lower wall is generally bag shaped.

10. An assembly as defined in claim 1 wherein said beverage material is selected from the group consisting of ground coffee, loose tea and fruit, vegetable or berry materials.

11. An assembly as defined in claim 1 further including, a tab connected to said beverage pouch which may be grasped by the user to lift said pouch out of said cup after the beverage has been brewed.

12. A brew-in-the-cup disposable beverage assembly using a premeasured charge of beverage material through which liquid is passed to create the beverage, the assembly comprising:

a cup having a sidewall defining a hollow interior, a bottom wall and an open top rim;

a beverage pouch, completely enclosing the premeasured charge of beverage material, having upper and lower filter wall regions, which permit the liquid to pass through while retaining the beverage material, and a peripheral region shaped to conform closely to said cup sidewall in an upper region thereof;

an airtight bag enclosing said beverage pouch to exclude air from the beverage material, said airtight bag being removable from said beverage pouch for use thereof;

pouch support structure connected to said cup sidewall projecting inwardly therefrom, said support structure underlying said beverage pouch adjacent said peripheral region to support said pouch in the upper region of said cup adjacent to the top rim;

pouch reinforcement structure connected to said pouch which reinforces the shape of the pouch in the peripheral region so that the pouch does not deform enough to become unseated from the support structure as liquid is passed through the pouch;

a cap removably fitted to said top rim of said cup, said cap having a drinking aperture therein to permit the user to drink the beverage from the cup with said cap in position on said rim; and wherein, upon removal of said airtight bag from said beverage pouch and placement of said pouch on said support structure with said pouch extending across the interior of said cup, the liquid is poured onto said beverage pouch to pass through and brew with the beverage material thereby providing the beverage in said cup.

* * * * *